United States Patent [19]

Mukumoto

[11] 4,196,646

[45] Apr. 8, 1980

[54] AUTOMATIC MEAT ARRANGING DEVICE FOR AUTOMATIC MEAT CUTTING MACHINE

[76] Inventor: Shigeyuki Mukumoto, 3-19, Yatouenoyama, Kawanishi-shi, Hyogo-ken, Japan

[21] Appl. No.: 920,421

[22] Filed: Jun. 29, 1978

[30] Foreign Application Priority Data

May 13, 1978 [JP] Japan ..... 53/56856
May 13, 1978 [JP] Japan ..... 53/56857

[51] Int. Cl.[2] ..... B26D 4/46
[52] U.S. Cl. ..... 83/88; 53/517
[58] Field of Search ..... 83/88; 53/517, 69

[56] References Cited

U.S. PATENT DOCUMENTS

| | | | |
|---|---|---|---|
| 1,310,261 | 7/1919 | Van Berkel | 83/88 |
| 3,834,259 | 9/1974 | Kuchler | 83/88 X |
| 3,842,698 | 10/1974 | Fitch et al. | 83/88 |
| 3,965,783 | 6/1976 | Müller et al. | 83/88 |

*Primary Examiner*—Donald R. Schran
*Attorney, Agent, or Firm*—Steele, Gould & Fried

[57] ABSTRACT

An automatic meat arranging device is adapted to send meat slices sequentially cut by an automatic meat cutting machine and regularly overlappingly arrange the meat slices on a meat tray which are sent by a meat slice conveying means and meat tray conveying means.

4 Claims, 10 Drawing Figures

AUTOMATIC MEAT ARRANGING DEVICE FOR AUTOMATIC MEAT CUTTING MACHINE

BACKGROUND OF THE INVENTION

This invention relates to an automatic meat arranging device used together with an automatic meat cutting machine and adapted to automatically arrange meat slices sequentially cut by the automatic meat cutting machine onto a meat tray.

A meat such as a pork and beef is usually sold in a lump or chop. For example, a beef for use as "sukiyaki" is sold in slices as cut by an automatic meat cutting machine. When sold in slices, the meat is packed in a spread-flat manner on a meat tray of synthetic resin with one slice overlappingly placed on another. A variety of devices for packing meat slices on a meat tray with a synthetic resin film are known, but a device for automatically arranging meat slices sequentially cut by an automatic meat cutting machine onto a meat tray has not yet been developed to date. For this reason, meat slices sequentially cut by the automatic meat cutting machine need to be arranged by hand on the meat tray. The operation of arranging such meat slices onto the meat tray is very inefficient and unsanitary. A meat mass is cut by a circular blade of the machine into slices. Since a piece of meat now being cut by the circular blade of the machine needs to be held by the human hand, a skill is required in the meat slicing operation land, in addition, there is a danger that the hand will be injured by a near-by circular blade of the machine.

An object of this invention is to provide an automatic meat arranging device capable of automatically arranging meat slices sequentially cut by an automatic meat cutting machine onto a meat tray.

Another object of this invention is to provide an automatic meat arranging device which permits meat slices sequentially cut by an automatic meat cutting machine to be overlappingly spread flat with the edge of one meat slice attractively displaced with respect to the edge of another.

Further objects and advantages of this invention will be apparent upon reading the following explanation made in conjunction with the preferred embodiments of this invention.

DETAILED DESCRIPTION OF THE INVENTION

Figure 1:
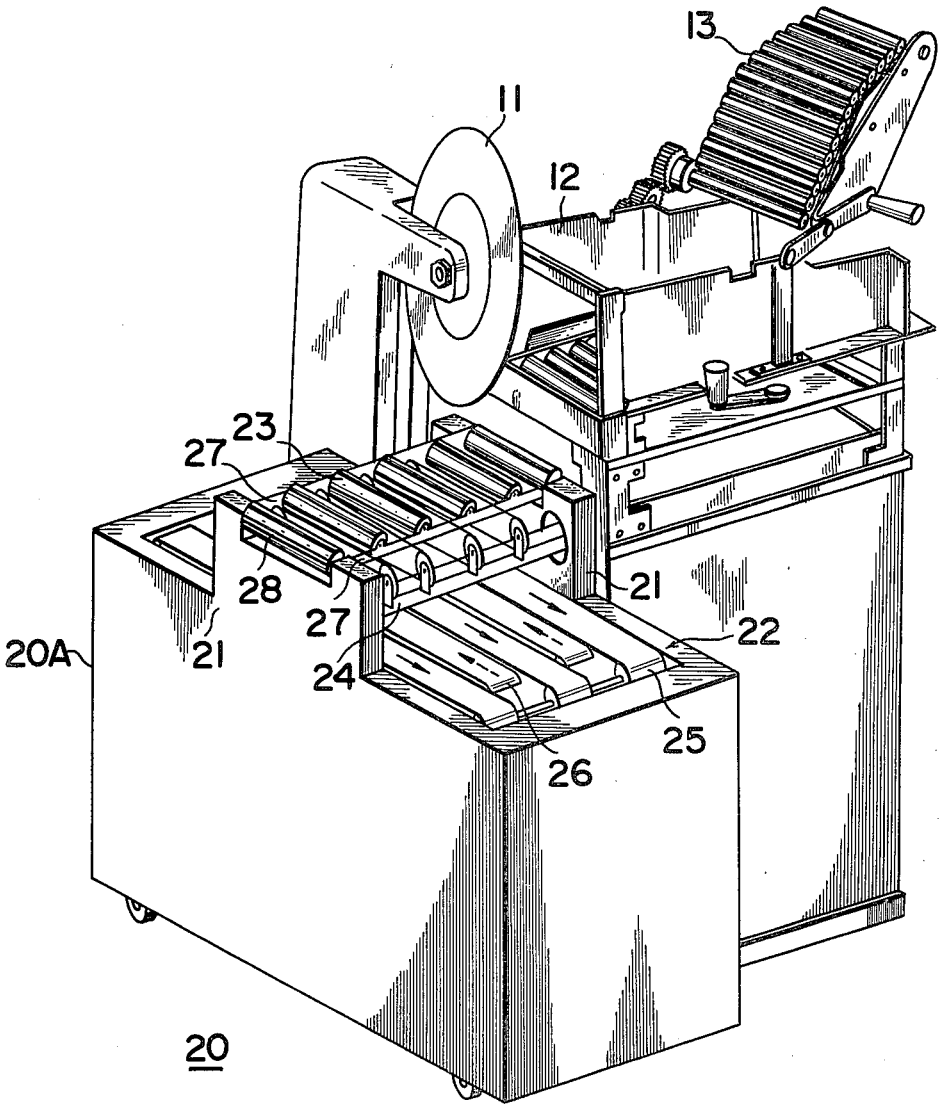
FIG. 1 is a perspective view showing, together with an automatic meat cutting machine, an automatic meat arranging device according to one embodiment of this invention.

In FIG. 1, 10 shows a conventional, ordinary automatic meat cutting machine, and 20 shows an automatic meat arranging device according to this invention which is mounted in a side-by-side relation to the automatic meat cutting machine 10.

The automatic meat cutting machine 10 includes a circular meat cutting blade 11 adapted to be rotated with the axis placed in the horizontal direction, a meat receiving case 12 disposed at one blade surface side of the circular blade 11 and adapted to be reciprocably moved along said one blade surface of the circular blade 11 and a meat feeding mechanism adapted to permit a meat mass or chop held in the meat receiving case 12 to be fed a predetermined feed length (width). Each time the meat feeding mechanism 13 causes the meat mass to be fed in such a fashion, the meat receiving case 12 makes one reciprocating movement to permit the feed length of the meat mass to be sliced by the circular blade 11.

The automatic meat arranging device 20 includes a movable boy 20A having casters and a meat receiving-/moving means 22 of which the meat receiving support sections are exposed at the open top surface of the movable body 20A. A pair of support walls 21, 21 are vertically disposed one at each side surface of the body 20A. A roller conveyor is bridged between the support walls 21 and 21. Between the support walls 21 and 21 is disposed a wire conveyor 24 which is positioned at a level lower than that of meat receiving roller conveyor 23.

The meat receiving/moving means 22 includes a plurality of forward conveying belts 25 at the open uper end of the body 20A and a plurality of return conveying belts 26 each of which are disposed between the respective forward conveying belts 25. The forward conveying belt 25 is operated, in a direction indicated by solid arrows, during a predetermined time period regulated by a timer. In this case, the operation of the conveying belt 25 is effected in response to a signal for detectng the end of the forward movement of the meat receiving case. The return conveying belt 26 is operated, in a direction indicated by dotted lines, during a predetermined time period regulated by the timer. The conveying belts 25 and 26 are driven by respective motors at the same speed. The conveying belt 26 is set such that the operation time thereof is shorter than that of the conveying belt 25.

Figure 2:
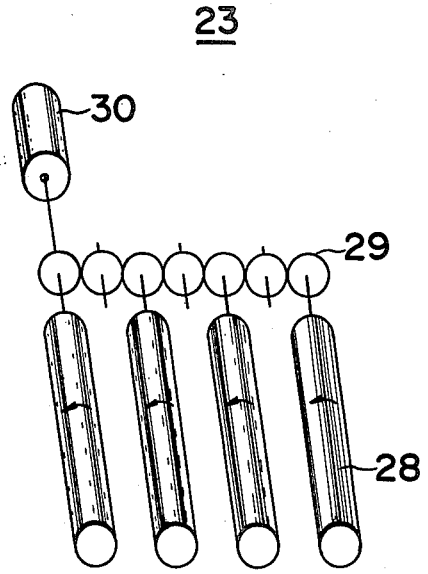
FIG. 2 is a perspective view showing a rotation roller array of the automatic meat arranging device of FIG. 1.
Figure 3:
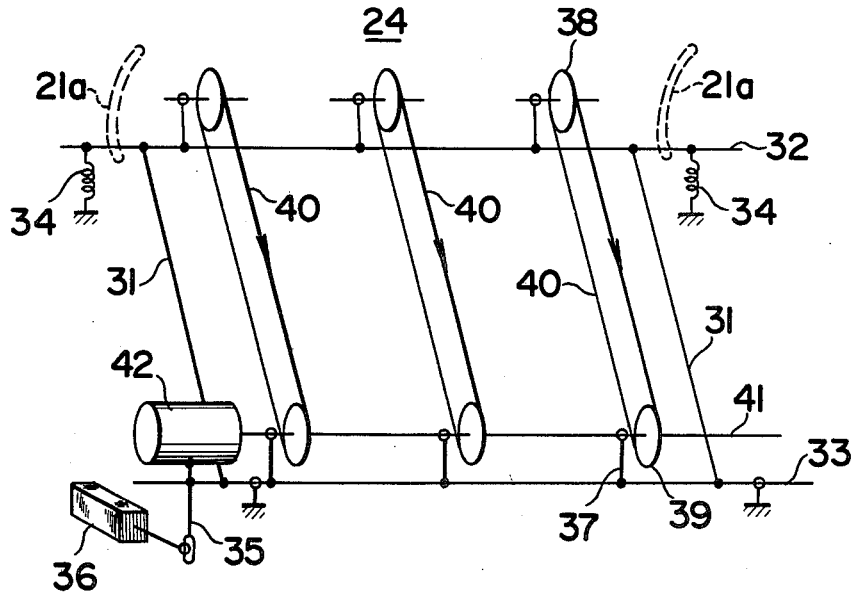
FIG. 3 is a schematic view showing a belt conveyor section of the automatic meat arranging device of FIG. 1.
Figure 4A:
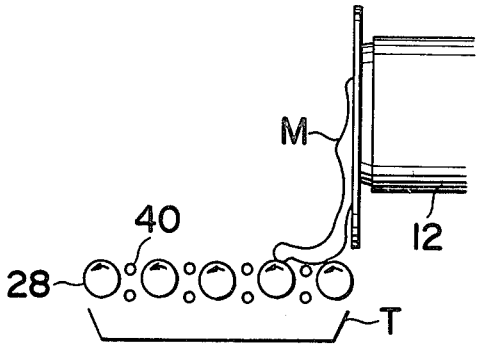
FIGS. 4(*a*) to 4(*e*) are views for explaining the operation of the automatic meat arranging device of FIG. 1.
Figure 4B:
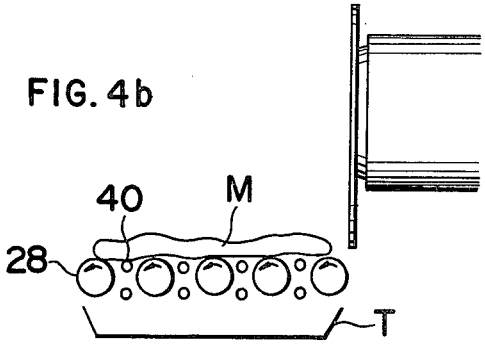
Figure 4C:
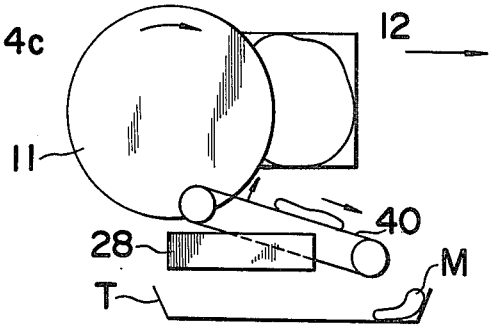
Figure 4D:
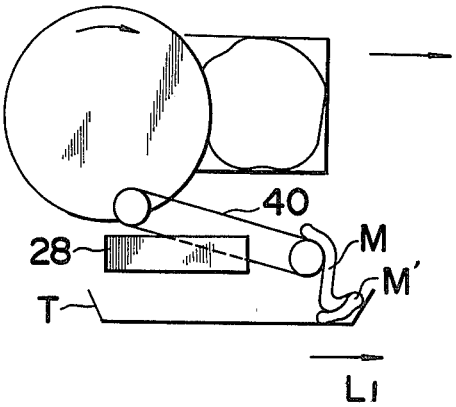
Figure 4E:
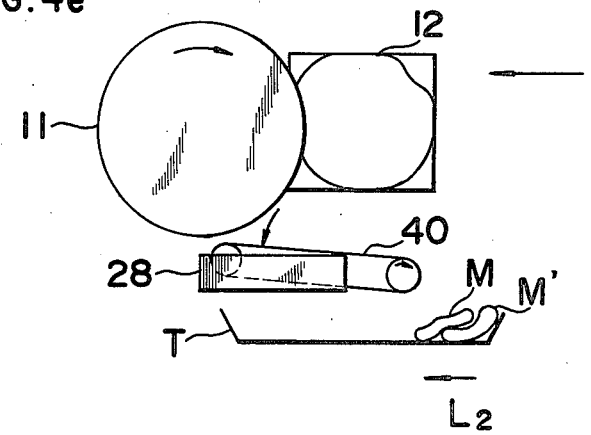

A roller conveyor 23 includes a number of adjacent rotation rollers 28 between a pair of parallel frames 27, 27 bridged between the support walls 21, 21, the respective rotation rollers 28 being rotatably supported. The respective rollers 28 are connected such that they can be rotated, in the same direction, through a gear train 29 as schematically shown in FIG. 2. The rollers 28 is driven by a motor 30. The wire conveyor 24 is such that a tiltable frame 31 is tiltably mounted between the support walls 21 and 21.

The tiltable frame 31 has a rear frame member 32 disposed below at the rear end of the roller 28 and a front frame member 33 disposed below at the front end of the roller 28. Both the ends of the front frame member 33 are rotatably journaled in bearings provided in the support walls and both the ends of the rear frame member are mounted such that they can be moved up and down in arcuate slots 21*a*, 21*a* in the support walls 21, 21. Springs 34 are attached to both the ends of the rear frame member 32 to urge the rear frame member 32 downward. A drive rod 35 depends from the end of the front frame member 33 and an electromagnetic plunger 36 is connected through an elongated hole to the lower end of the drive rod 35. Support pieces 37 are attached upright to the front and rear frame members 32 and 33 with each of the support pieces between the rollers. Rear pulleys 38 are rotatably supported on the support pieces 37 of the rear frame member 32. Front pulleys 39 are rotatably supported on the support pieces 37 of the front frame member 37. Endless conveying wires 40 are each run between the corresponding front and rear pulleys 38 and 39 with the upper half thereof above the frame. A common drive shaft 41 extends through the front pulleys 39. Between the support walls 21, 21 the drive shaft 41 is adapted to be rotated, in a direction indicated by arrows, by a motor 42 fixed to the end of the front frame 33. The electromagnetic plunger 36 permits an attractive movement for the above-mentioned predetermined time period in response to the above-mentioned end detection signal.

The operation of the machine according to one embodiment of this invention will now be explained below.

As shown in FIG. 4 the automatic meat arranging device is located in a side-by-side relation to the automatic meat cutting machine of which the circular blade 11 is in an operative position. A meat tray T is disposed on the forwarding and return belts 25 and 26 of the tray moving means 22, but it is located substantially below the wire conveyor 24. When in this state the automatic meat cutting machine 10 is operated a meat slice M cut from a meat mass is received on the rollers 28 as shown in FIG. 4(*a*) and sequentially spread on the rollers, while moving in a lengthwise direction according to the rotation of the rollers 28. When the slice is completely cut away from the meat mass, the slice M is completely spread flat on the roller conveyor 23 as shown in FIG. 4(*b*). At this time, the automatic meat cutting machine 10 delivers a signal for detecting the end of the forward movement of the meat receiving case 12. The signal is supplied to the side of the automatic meat arranging device 20. In consequence, the electromagnetic plunger of the automatic meat arrangement device 20 is attracted during a predetermined time period in response to the signal, causing an upward tilting movement to be effected against the biasing force of the spring 34 of the tiltable frame 31 with the front frame member 33 as a fulcrum. In consequence, the slice M is raised from the rollers 28 in a manner supported by the belt conveyor 40 as shown in FIG. 4(*c*) and delivered in a direction transverse to the conveying direction of the roller 28 i.e. to the width of the slice M. As shown in FIG. 4(*d*), the slice M is sent onto the meat tray T from the front pulley 39 side. At this time, the tray moving means 22 causes the forward conveying belt 25 to be operated in response to the above-mentioned signal to permit the tray T to be moved in the same direction as the slice M conveying direction. Thus, the slice M is delivered in a manner spread flat on the tray T. When the meat tray T completely receives the slice M as shown in FIG. 4(*e*), the belt 25 stops its forward movement and the return conveyor belt 26 starts its return operation, bringing the meat tray back to the original positon. Since in this case a forward travel $L_1$ of the forward conveying belt 26 is set such that it is smaller than a return travel $L_2$ of the return conveying belt, the meat slice receiving position is displaced by an amount corresponding to a difference between the forward travel $L_1$ of the forward conveying belt and the return travel $L_2$ of the return conveying belt. That is, the meat slice receiving position is displaced in the forward direction with the slice M overlappingly placed on the predecessor slice $M_1$ i.e. the edge of the meat slice M attractively displaced with respect to the edge of the predecessor slice $M_1$. When such operation cycle is repeated, slices are automatically sequentially cut by the circular blade from the meat mass and then automatically attractively arranged, while spread flat, on the meat tray in a mutually overlapping manner. When the tray filled with such meat slices, it can be replaced by a new one so that the above-mentioned operation can be continuously effected.

Figure 5:
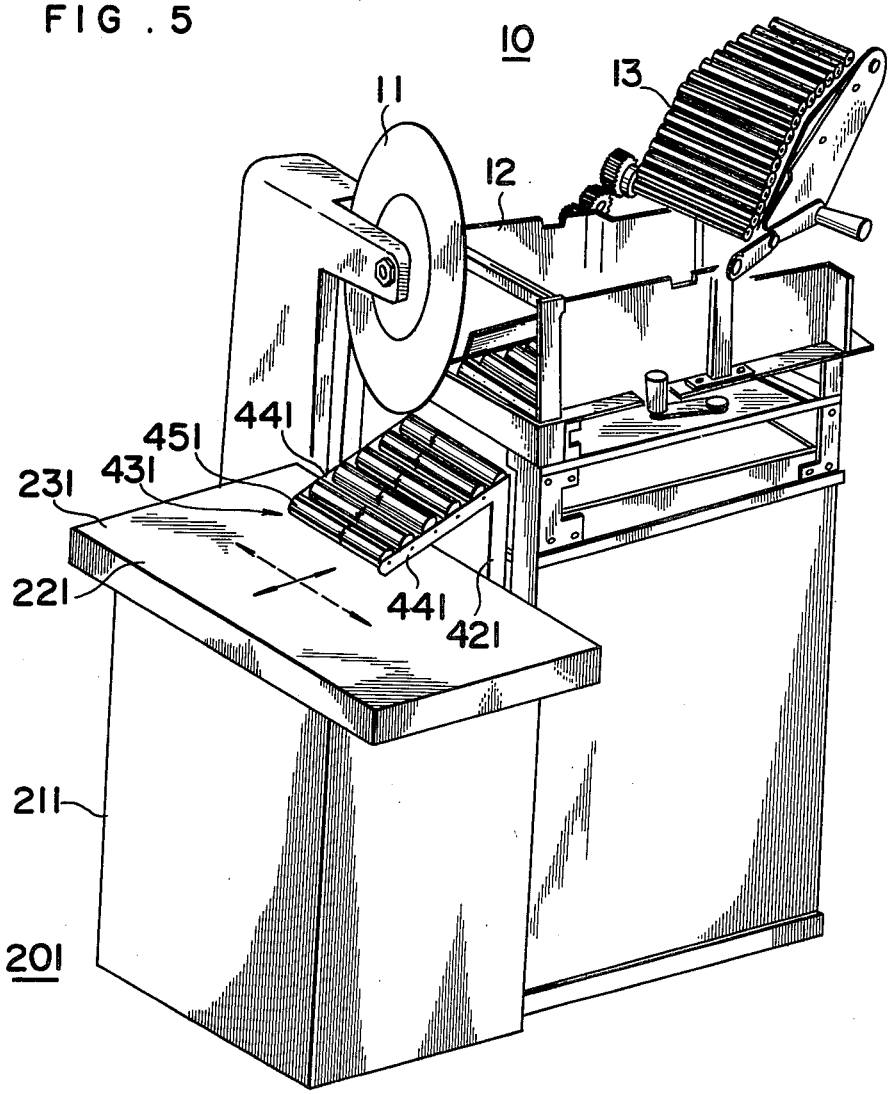
FIG. 5 is a perspective view showing, together with an automatic meat cutting machine, an automatic meat arranging device according to another embodiment of this invention.
Figure 6:
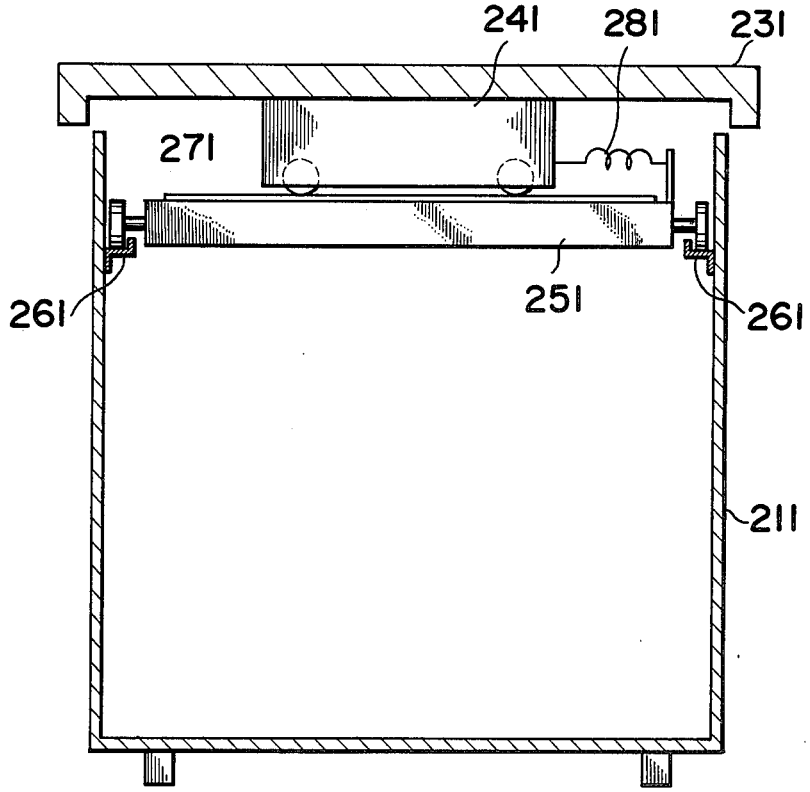
FIG. 6 is a cross-sectional view of the automatic meat arranging device of FIG. 5.
Figure 7:
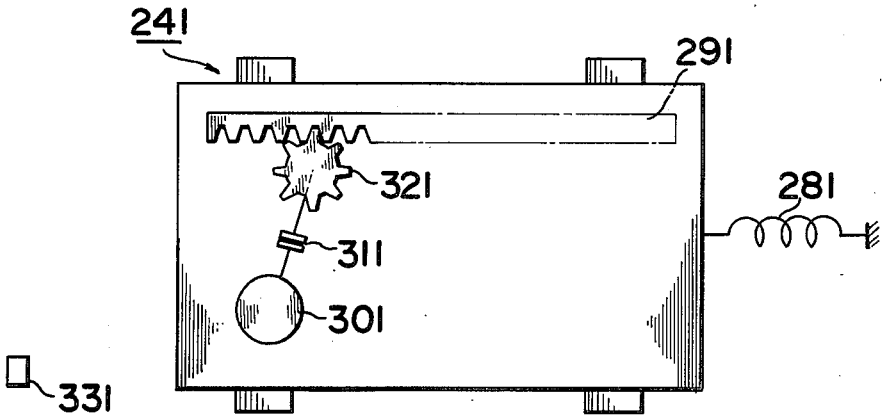
FIG. 7 is a schematic view showing an upper moving carrier of the automatic meat arranging device of FIG. 5.

FIG. 5 shows a meat cutting machine 10 the same in type as in FIG. 1, which is disposed in a side-by-side relation to an automatic meat arranging device. The automatic meat arranging device 201 includes a meat tray moving means 221 placed on a movable body 211 having casters. The meat tray moving means 221 has a moving table 231 on the device body 211. As shown in FIG. 6 the moving table 231 is supported on an upper moving carrier which in turn is supported on a lower moving carrier 251. The lower moving carrier 251 is reciprocably moved on rails 261 on the device body 211 in a direction indicated by dotted arrows. The upper moving carrier 241 can be moved on rails 271 on the lower moving carrier 251 in a direction indicated by solid arrows i.e. in a direction orthogonal to the moving direction of the lower moving carrier 251. As shown in FIG. 7 the upper moving carrier 241 is biased by a spring 281 in one direction and has a rack 291 in mesh with a pinion 321 driven by a motor through an electromagnetic clutch 311. The carrier 241 is moved against the biasing force of the spring 281.

The electromagnetic clutch 311 is operated in response to a signal generated upon detection of the completion of the forward movement of a meat receiving case 12 in the automatic meat cutting machine 10. When the carrier 241 is moved up to a predetermined position, the position is detected by a limit switch 331 to cause the carrier 241 to be returned to the non-operative state.

Figure 8:
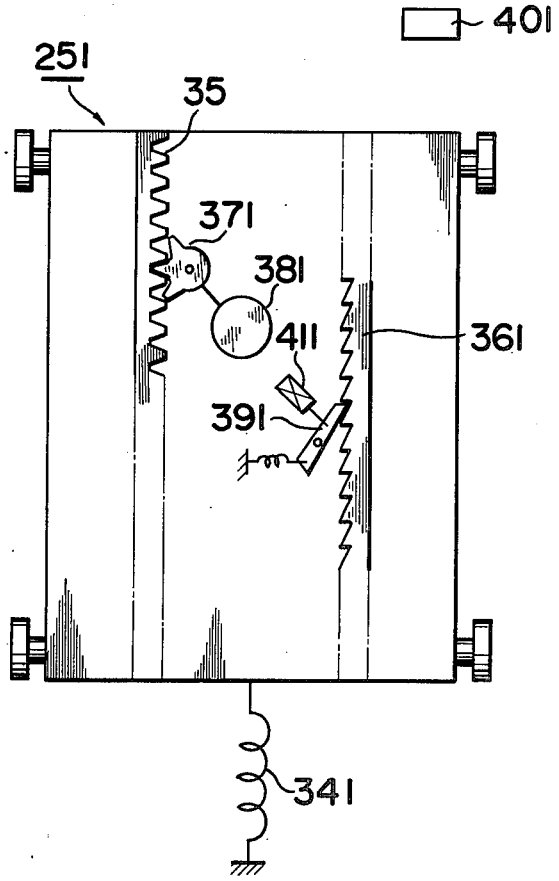
FIG. 8 is a schematic view showing a lower moving carrier of the automatic meat arranging device of FIG. 5.

The lower moving carrier 251 is biased by a spring 341 in one direction as shown in FIG. 8 and has a rack 351 and ratchet 361. A sector-like gear 371 in mesh with the rack 351 is driven by a motor 381, causing the rack 351 to be intermittently moved in a direction opposite to the biasing direction of the spring 341. The moving position of the ratchet 361 is held by a ratchet pawl 391 engaged with a latchet 361. The motor 381 for driving the sector-like gear 371 causes the sector-like gear 371 to make one rotation each time the upper moving carrier 241 makes one reciprocating movement. The ratchet pawl 391 is biased by a spring 341 in the ratchet-latching direction. When the lower moving carrier 251 is moved to a predetermined position, a latching engagement of the ratchet pawl 391 with a ratchet 361 is released to cause the lower moving carrier 251 to be returned by the spring 341 to the original position.

Figure 9:
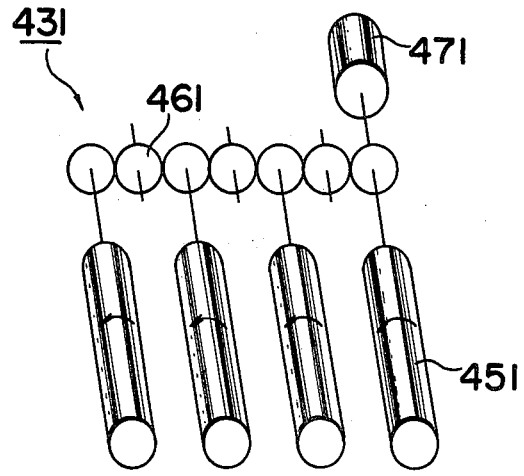
FIG. 9 is a perspective view showing a rotation roller array of the automatic meat arranging device of FIG. 5.
Figure 10A:
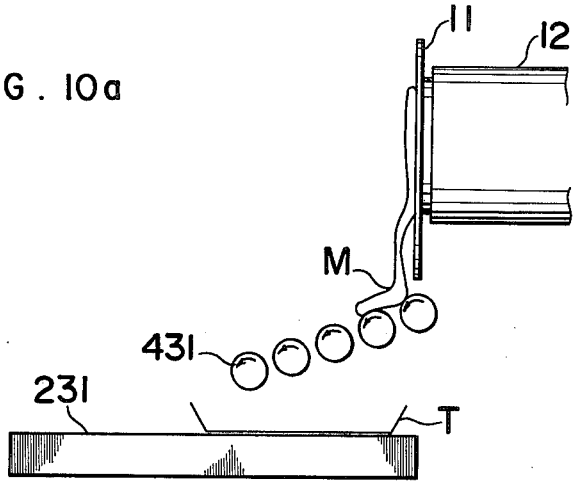
FIGS. 10(*a*) to 10(*f*) are views for explaining the operation of the automatic meat arranging device of FIG. 5.
Figure 10B:
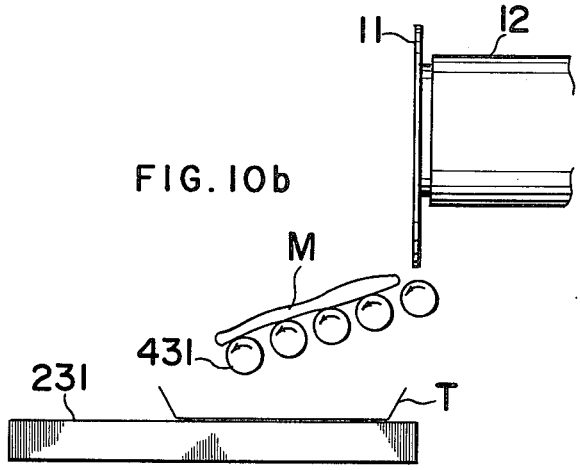
Figure 10C:
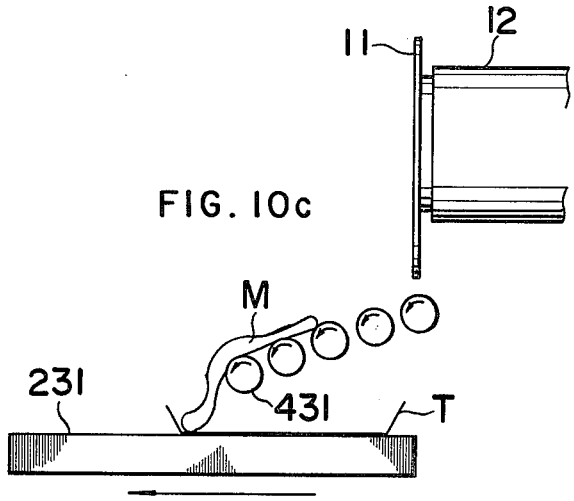
Figure 10D:
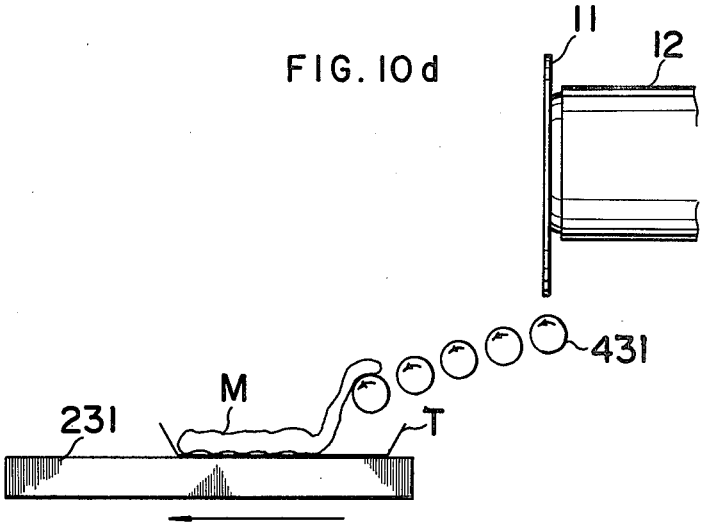
Figure 10E:
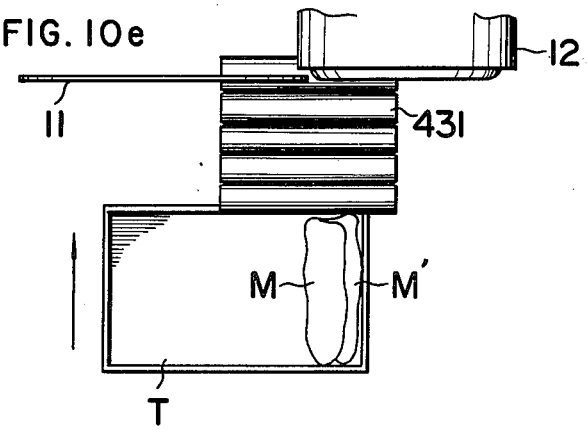
Figure 10F:
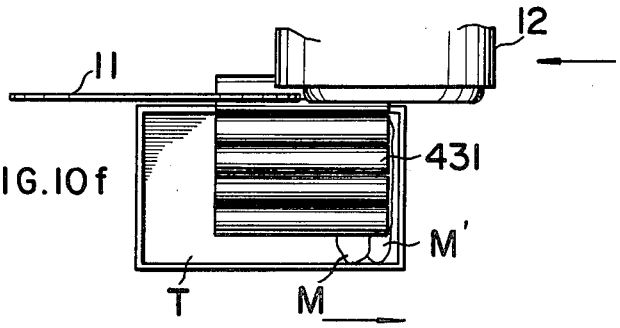

At one side of the device body 211, a support wall 421 is extended upward beyond the upper surface of the table and a roller conveyor 431 is supported above the upper end of the support wall 421. The roller conveyor 431 is supported by a pair of parallel frames 441 and can be inclined down toward the central area of the table 231. A number of parallel rotation rollers 451 are arranged between the frames 441 and rotatably supported. As shown in FIG. 9 the respective rotation rollers 451 are connected at one end to a gear train 461 so that they can be rotated in the same direction by a motor 471 mounted on the support wall 421.

The operation of the automatic meat arranging device 20 of this invention will now be explained below by referring to FIGS. 10(*a*) to 10(*f*).

The meat arranging device 20 is positioned in a side-by-side relation to the automatic meat cutting machine such that the upper end of the roller conveyor 431 is placed below the circular blade 11 of the automatic meat cutting machine. A meat receiving tray T is disposed on the table 231 and substantially below the roller conveyor 431. When in this state the automatic meat cutting machine is operated, a meat slice M is cut from a meat mass as shown in FIG. 10(*a*) and placed on the roller conveyor 431. The slice M is sequentially moved on the roller conveyor 431 and completely spread flat when the slice M is completely cut away from the meat mass. As shown in FIG. 10(*c*) the slice M is further moved and placed onto the meat tray T as shown in FIG. 10(*c*). When the slice M is cut away from the meat mass, i.e., when the automatic meat cutting machine 10 completes its forward movement, a detection signal for detecting the end of the forward movement is generated. In response to the detection signal the electromagnetic clutch 311 is operated to cause the pinion 321 to be driven by the motor 301. As a result, the upper moving carrier 241 is moved, through the rack 291, against the biasing force of the spring 281 and the table 231, together with the tray T, is moved in the same direction as that in which the slice M is moved on the roller conveyor. The meat is placed from the roller conveyor 431 onto the tray T such that it is spread flat as shown in FIG. 10(*d*). When the slice M is completely received on the tray T, the upper moving carrier 241 reaches a predetermined position in which a limit switch 331 is disposed. By the operation of the limit switch 331 the electromagnetic clutch 311 is returned to the non-operative state and the upper moving carrier 241 is returned to the original position. As shown in FIG. 10(*f*) the tray T is again returned to that position where it is disposed below the roller conveyor 431. When the upper moving carrier 241 makes one reciprocating movement, the motor 381 causes the sector-like gear 371 to make one rotation. As a result, the lower moving carrier 251 is moved through the rack 351 in a direction orthogonal to that in which the upper moving carrier 241 is moved. In this case, the lower moving carrier 25 is moved a predetermined pitch corresponding to an amount of overlap of meat slices so that one meat slice is overlappingly placed onto another as shown in FIG. 10(*f*).

When such operation cycle is repeated, meat slices M are sequentially cut away from the automatic meat cutting machine 10 and overlappingly attractively placed onto the tray T. When the tray T is filled with such meat slices, the lower moving carrier 251 reaches a predetermined position, causing the limit switch 401 to be actuated to permit the ratchet pawl 391 to be disengaged from the ratchet 361 through the electromagnetic plunger 411. When the ratchet pawl 391 is so disengaged from the ratchet 361, the lower moving carrier 251 and thus the moving table 231 is returned by the spring 341 to the original position. At this time, the tray T can be replaced by a new one for continuous operation. Although in the above-mentioned embodiment the movable table 23 (tray moving means) is orthogonally moved in a plane, a tray conveying belt may be moved, as in the belt conveyor (25, 26) of FIG. 1, in a direction orthogonal to that in which the moving table is moved. In this case, the tray conveying belt is intermittently moved by a predetermined pitch.

What is claimed is:

1. An automatic meat arranging device for an automatic meat cutting machine comprising:

meat slice conveying means for receiving a meat slice sequentially cut by the automatic meat cutting machine and for sending the meat slice in a spread-flat fashion to a predetermined meat receiving position; and means forwardly moving a meat tray from the meat receiving position to a position where the meat slice is completely received on the meat tray, and returning the meat tray to said meat receiving position so that a repetitive reciprocating movement can be effected, the forward movement of the meat tray moving means being effected at a speed synchronized with a meat feeding speed and in the same direction as the meat slice feeding direction of said meat slice conveying means, said meat tray moving means further displacing said meat tray a desired amount for each one reciprocating movement so that one meat slice is overlappingly placed on another on the meat tray with the edge of the meat slice displaced with respect to the edge of the adjacent meat slice.

2. An automatic meat arranging device according to claim 1, in which said meat tray conveying means comprises a first moving carrier and a second moving carrier adapted to be moved, after each one reciprocating movement of said first moving carrier, in a direction orthogonal to that in which the first moving carrier makes such reciprocating movement, said first and second moving means being arranged on above the other.

3. An automatic meat arranging device according to claim 2, in which said second moving carrier is returned to the original position after it is moved a predetermined number of times.

4. An automatic meat arranging device according to claim 1, wherein said meat slice conveying means comprises a plurality of parallel rollers for receiving a meat slice sequentially cut by the automatic meat cutting machine.

* * * * *